US006833522B1

(12) United States Patent
Park et al.

(10) Patent No.: US 6,833,522 B1
(45) Date of Patent: Dec. 21, 2004

(54) KEY SWITCH DEVICE AND METHOD FOR MANUFACTURING THE SAME

(75) Inventors: Kyung-Su Park, Kyunggi-Do (KR); Chul-Gi Min, Kyunggi-Do (KR); Jeong-Hun Lee, Kyunggi-Do (KR)

(73) Assignee: Samsung Electro-Mechanics Co., Ltd., Kyunggi-Do (KR)

( * ) Notice: Subject to any disclaimer, the term of this patent is extended or adjusted under 35 U.S.C. 154(b) by 0 days.

(21) Appl. No.: 10/781,996

(22) Filed: Feb. 19, 2004

(30) Foreign Application Priority Data

Sep. 30, 2003 (KR) ..... 10-2003-67898

(51) Int. Cl.[7] ..... H01H 13/70

(52) U.S. Cl. ..... 200/344; 200/5 A; 200/17 R; 400/490

(58) Field of Search ..... 200/344, 345, 200/5 R, 5 A, 17 R; 400/490–491, 495.1

(56) References Cited

U.S. PATENT DOCUMENTS 4,659,879 A * 4/1987 Hasegawa ..... 200/5 A
5,562,203 A * 10/1996 Mochizuki ..... 200/345
6,040,541 A * 3/2000 Li ..... 200/344
6,130,388 A * 10/2000 Nishijima ..... 200/293
6,455,794 B2 * 9/2002 Sato et al. ..... 200/344
6,501,038 B2 * 12/2002 Hayashi et al. ..... 200/344
6,657,139 B2 * 12/2003 Hasunuma ..... 200/5 A

FOREIGN PATENT DOCUMENTS

JP 2924427 5/1999
JP 05225858 7/1999

* cited by examiner

*Primary Examiner*—Kyung Lee
(74) *Attorney, Agent, or Firm*—Gottlieb, Rackman & Reisman, P.C.

(57) ABSTRACT

A key switch device includes inner and outer link members connected to each other to mutually move in a scissors fashion, a key top having receiving portions for receiving the support protrusions provided at respective upper ends of the link members, a hollow elastic switch provided at an inner surface thereof with a downward protrusion for performing a switching operation in accordance with vertical movement of the key top, a support plate arranged beneath the key top, a membrane arranged on the support plate, and a mounting member arranged on the membrane, a central opening for receiving the elastic switch, and fitting holes allowing the cocking members to be fitted therein.

14 Claims, 6 Drawing Sheets

KEY SWITCH DEVICE AND METHOD FOR MANUFACTURING THE SAME

BACKGROUND OF THE INVENTION

1. Field of the Invention

The present invention relates to a key switch device, and more particularly to a key switch device having a structure capable of preventing its key top from being tilted, thereby maintaining the key top in a stable use state, while easily providing a desired waterproofing effect.

2. Description of the Related Art

Generally, portable electronic devices such as notobook computers use a keyboard including a plurality of key switch devices for a key input operation. Each key switch device includes a guide member consisting of a pair of links connected to each other in a crossing manner while being movable with respect to each other. The guide member has a function for guiding vertical movement of the key top to thereby effect a switching operation.

Such a key switch device is disclosed in a number of publications. An example of such a key switch device is disclosed in the Japanese Patent Publication No. 2924427 titled "KEY SWITCH DEVICE". Now, the structure of the key switch device disclosed in the publication will be described in brief with reference to FIG. 1.

The key switch device shown in FIG. 1 includes a key top 101 provided at a lower surface thereof with two mounting portions 102 and 103 vertically downwardly protruded from the lower surface of the key top 101, and a switching member 131 provided at its inner surface with a downward protrusion, and adapted to perform a switching operation in accordance with vertical movement of the key top 101. A support member 106 is arranged between the key top 101 and the switching member 131. The support member 106 includes two link members 107 and 108 connected to each other such that they are movable with respect to each other. Each of the link members 107 and 108 is provided at opposite ends thereof with mounting pins 115 and 121, respectively.

A flexible printed circuit board 130 is arranged beneath the switching member 131 while being supported by the upper surface of a support plate 125. Mounting pieces 135 and 136 corresponding to respective mounting portions 102 and 103 of the key top 101 are provided at the support plate 125.

The support plate 125 is made of a metal plate. The mounting pieces 135 and 136 are formed by cutting desired portions of the support plate 125, and then upwardly bending the cut portions. Accordingly, the mounting pieces 135 and 136 are integral with the support plate 125. The flexible printed circuit board 130 is provided with through holes (not shown) corresponding to respective mounting pieces 135 and 136.

The switching member 131 is made of a rubber material, so that it can serve to upwardly urges the key top 101 against a downward force applied to the key top 101 by its resilience.

In the conventional key switching device having the above mentioned configuration, the link members 107 and 108 move mutually in a scissors fashion when the user depresses the key top 101, thereby causing the key top 101 to move downwardly. When the depressing force is released, the key top returns to its original position by virtue of the resilience of the switching member 131. In the above procedure, the switching member 131 comes into contact with a contact on the flexible printed circuit board 130, thereby effecting a switching operation.

However, the above mentioned conventional key switch device has the following drawbacks.

First, there is a drawback in that it is difficult to machine the mounting pieces 135 and 136, to be engaged with the mounting pins 115 and 121, in a high accuracy because they should be integrally formed with the support plate 125, made of a metal, while having a structure protruded from the support plate 125. Accordingly, the support plate 125 is typically manufactured, using a relatively flexible metal material such as aluminum, in order to easily machine the mounting pieces 135 and 136 in a high accuracy. In this case, however, the mounting pieces 135 and 136 may be easily bent or broken, even when they are subjected to low pressure, because the strength of aluminum is low. Even when any one of the mounting pieces 135 and 136 is bent or broken, the support plate 125 cannot operate normally, so that it is necessary to replace the support plate 125 with a new one.

Where the support plate 125 is used for a keyboard including a plurality of key switch devices, it has a structure in which a plurality of mounting pieces 135 and 136 associated with the key switch devices are arranged in the form of a matrix. In this case, the formation of the mounting pieces 135 and 136 becomes more difficult in proportion to the number of the mounting pieces 135 and 136. As a result, it is difficult to manufacture the support plate 125.

Meanwhile, each key switch device included in a keyboard equipped in a notebook computer is required to have a structure in which its key top 101 is horizontally maintained at a constant level without being tilted, while having a long stroke.

In the above mentioned conventional key switch device, however, it is difficult to machine the mounting pieces 135 and 136 in the high accuracy required in the key switch device. Since the mounting pieces 135 and 136 are made of a flexible material such as aluminum, they may also be easily bent, tilt to one side thereof, or broken, even when they are subjected to low pressure. For this reason, the key top 101 may be tilted without being horizontally maintained.

Since the mounting pins 115 and 121 have a cylindrical shape, their area contacting the mounting pieces 135 and 136 and the support plate 125 is also small. As a result, the mounting pins 115 and 121 cannot stably support the key top 101. Furthermore, there is no structure for maintaining the key top 101 in a horizontal state. For this reason, it is impossible to prevent the key top 101 from being tilted.

In the above mentioned key switch device, its mounting pieces 135 and 136 are formed by cutting desired portions of the support plate 125, and bending the cut portions such that the cut portions are protruded from the support plate 125. As a result, holes are perforated through the support plate 125 at regions where the mounting pieces 135 and 136 are formed, respectively. For this reason-, there is a drawback in that it is necessary to attach a waterproofing tape to the lower surface of the support plate 125 or to otherwise close the holes, in order to waterproof the keyboard.

This results in an increase in the number of elements to be assembled and an increase in the number of assembly processes, thereby causing a degradation in productivity and an increase in manufacturing cost.

Also, in the conventional key switch device, the link members 107 and 108 are directly coupled to the mounting pieces 135 and 136 formed at the support plate 125, respectively. For this reason, the sliding movements of the link members 107 and 108 are limited by the height of the mounting pieces 135 and 136 formed by the cut portions of the support plate 125. Thus, the mounting pieces 135 and 136 serve as stoppers determining the height of the key switch device. In other words, the thickness of the support plate 125 determining the height of the keyboard corresponds to the thickness of the mounting plates 135 and 136. Accordingly, it is necessary to increase the thickness of the mounting plates 135 and 136 for a stable use state of the keyboard. In this case, however, there is a problem in that the height of the keyboard increases.

SUMMARY OF THE INVENTION

Therefore, the present invention has been made in view of the above mentioned problems, and an object of the invention is to provide a key switch device in which mounting pieces, to be engaged with mounting pins for guiding vertical movement of a key top, are formed, separately from a support plate adapted to support a printed circuit board, so that the support plate can be easily manufactured.

Another object of the invention is to provide a key switch device in which mounting pieces, to be engaged with mounting pins for guiding vertical movement of a key top, are formed, separately from a support plate adapted to support a printed circuit board, so that the key switch device has a firm structure.

Another object of the invention is to provide a key switch device capable of preventing its key top from being tilted, thereby providing a stable use state of the key top.

Another object of the invention is to provide a key switch device having a structure capable of providing a waterproofing effect without using a waterproofing tape or any other element, thereby reducing the number of elements to be assembled and the number of assembly processes, while achieving an improvement in the workability of the assembly process.

Another object of the invention is to provide a keyboard which has a reduced key height, so that it has a slim structure.

In accordance with one aspect, the present invention provides a key switch device comprising: inner and outer link members connected to each other in a crossing manner to mutually move in a scissors fashion, each of the inner and outer link members having support protrusions respectively provided in pairs at lower and upper ends thereof; a key top provided with receiving portions adapted to receive the support protrusions provided at respective upper ends of the inner and outer link members; a elastic switch provided at an inner surface thereof with a downward protrusion adapted to perform a switching operation in accordance with a vertical movement of the key top; a support plate arranged beneath the key top, and provided with cocking members at predetermined positions, respectively; a membrane arranged on the support plate, and printed with a circuit having a contact, with which the downward protrusion of the elastic switch comes into contact, and a switch pattern, the membrane having slots for allowing the cocking members to be upwardly protruded therethrough; and a mounting member arranged on the membrane, the mounting member having support pieces adapted to be engaged with respective support protrusions provided at the lower ends of the inner and outer link members, a central opening adapted to receive the elastic switch, and fitting holes adapted to allow the cocking members to be fitted therein.

Preferably, at least one of the support protrusion pairs provided at respective lower ends of the inner and outer link members has horizontal surfaces provided at respective support protrusions of the at least one support protrusion pairs, and adapted to come into contact with the support plate when the key top moves upwardly to a predetermined level, thereby stopping the upward movement of the key top. The support protrusions provided with the horizontal surfaces may be provided at the lower end of the outer link member.

The support protrusions provided at the lower end of the inner link member may have a cylindrical structure while being laterally movable during the scissors movements of the inner and outer link members.

Preferably, the inner link member is provided at a lower surface thereof with a support groove adapted to come into contact with one lateral end of the mounting member when the key top moves upwardly to the predetermined level, thereby vertically supporting the inner link member. The support groove may have an arc shape.

Preferably, the opening of the mounting member has a circular shape, and the mounting member has an annular frame formed around the circular opening while having a predetermined thickness.

The support pieces of the mounting member may be provided in pairs at front and rear ends of the mounting member, respectively, such that the support pieces included in the support piece pair provided at the front end of the mounting member are engaged with respective support protrusions provided at the lower end of the inner link member, whereas the support pieces included in the support piece pair provided at the rear end of the mounting member are engaged with respective support protrusions provided at the lower end of the outer link member. Each of the support pieces may have a 180°-rotated L shape.

Preferably, the mounting member is made of stainless steel.

Preferably, the fitting holes are arranged at opposite sides of the opening, respectively, such that they are symmetrical with respect to a center line of the opening. The mounting member may have recesses respectively formed around the fitting holes.

In accordance with another aspect, the present invention provides a method for manufacturing a key switch device, comprising the steps of: (A) cutting a plurality of first sheets respectively corresponding to the key switch devices to be manufactured, while having a predetermined strength, and forming support pieces, an opening, and fitting holes at each of the cut first sheets, thereby forming a plurality of mounting members respectively corresponding to the key switch devices; (B) cutting a second sheet to have a structure conforming to a shape required in a keyboard, and forming a plurality of cocking members at the cut second sheet, thereby forming a support plate; (C) preparing a membrane printed with a flexible switching circuit, and forming a plurality of slots, corresponding in number to the cocking members, at positions corresponding to those of the cocking members, respectively; (D) attaching the membrane to an upper surface of the support plate, positioning the mounting members on the membrane such that the cocking members are fitted in the coupling holes of the mounting members through the slots of the membrane, and protruded from the coupling holes at upper ends thereof, respectively, and applying a downward pressure to the protruded upper ends of the cocking members, thereby fixing the mounting members to the support plate; (E) arranging elastic switches in respective central openings of the mounting members fixed to the support plate; (F) preparing a plurality of linkages each including inner and outer link members connected to each other in a crossing manner to mutually move in a scissors fashion, each of the inner and outer link members having support protrusions provided at lower and upper ends thereof, and engaging the support protrusions provided at respective lower ends of the inner and outer-link members included in each of the linkages with the support pieces provided at an associated one of the mounting members, respectively; and (G) preparing a plurality of key tops each having receiving portions, and assembling the key tops to the linkages such that the support protrusions provided at respective upper ends of the inner and outer link members included in each of the linkages are received in and engaged with the receiving portions of an associated one of the key tops, respectively.

Preferably, the slots are formed, at the step (C), to have a size equal to or slightly larger than that of the cocking members.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, a key switching device according to the present invention and a method for manufacturing the key switching device will be described in detail with reference to the annexed drawings.

In the following description, "front" and "rear" mean the front and rear sides on the drawings, respectively, whereas "upper" and "lower" mean the upper and lower sides on the drawings, respectively.

Figure 1:
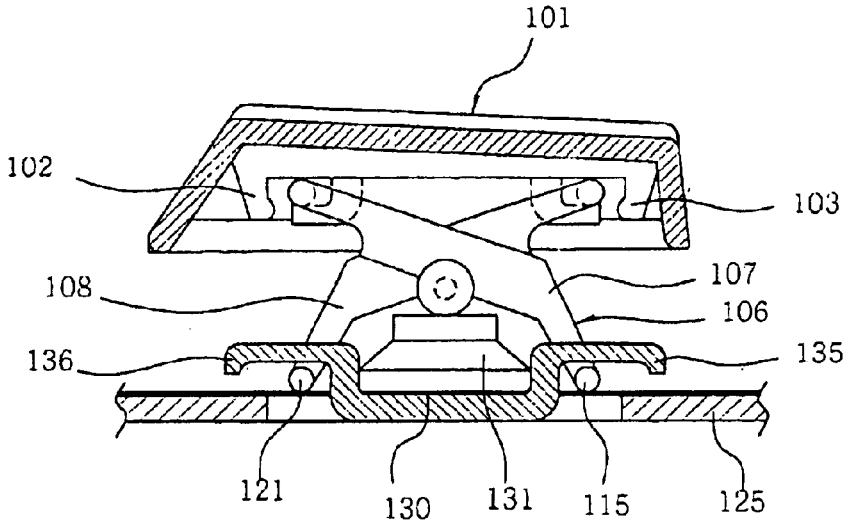
FIG. 1 PRIOR ART
FIG. 1 is a partially-broken away side view of a conventional key switch device.
Figure 2:
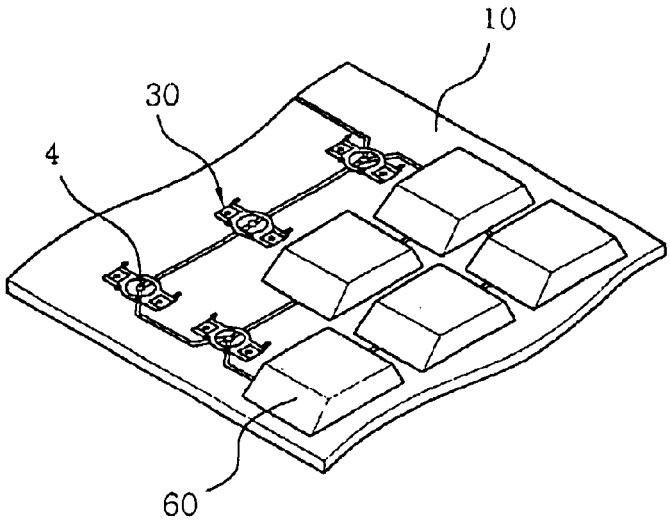
FIG. 2 is a perspective view showing the inner structure of a keyboard which employs a key switch device according to the present invention.

FIG. 2 is a perspective view showing the inner structure of a keyboard which employs the key switch device according to the present invention.

Where the keyboard is applied to a portable electronic appliance such as a notebook computer, it includes a thin support plate 10 on which a circuit formed with switch patterns including a plurality of contacts 9 is arranged, as shown in FIG. 2. The support plate 10 is fabricated by use of a sheet made of aluminum, iron, stainless steel, or other metal. The circuit is printed on an insulating membrane 20 (FIG. 3) having a multiple structure.

A plurality of key tops 60 are mounted on the support plate 10 such that they are arranged over respective contacts 4. Accordingly, when one key top 60 is depressed, an associated one of the contacts 4 senses the depression of the key top 60. In accordance with the present invention, each key switch device includes a mounting member 30 which is separate from the support plate 10. In FIG. 2, a part of the key tops 60 are in a state of being removed, so as to expose the mounting members 30 arranged therebeneath, and the contacts 4 arranged inside the mounting members 30.

Figure 3:
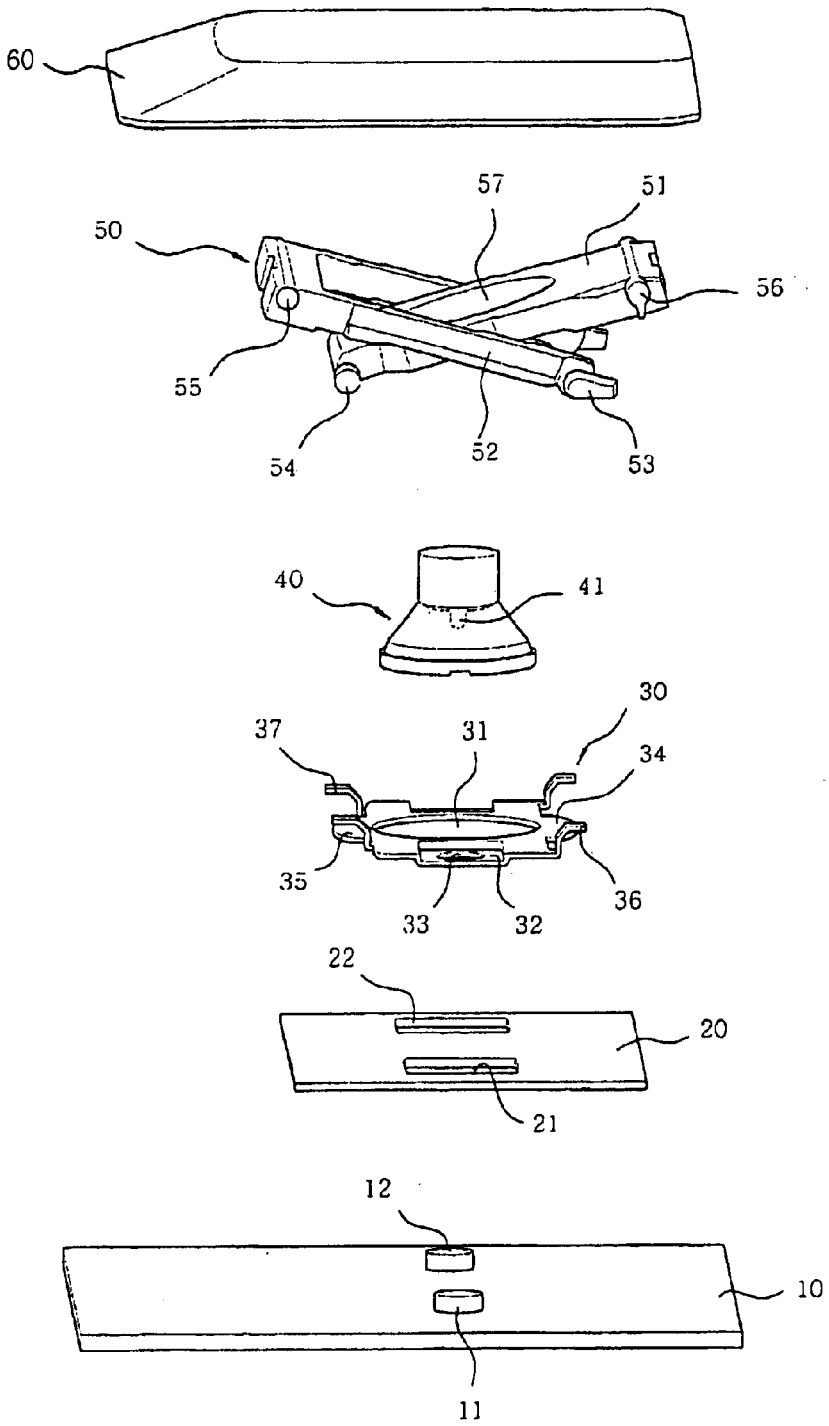
FIG. 3 is an exploded perspective view illustrating the key switch device according to the present invention.
Figure 4:
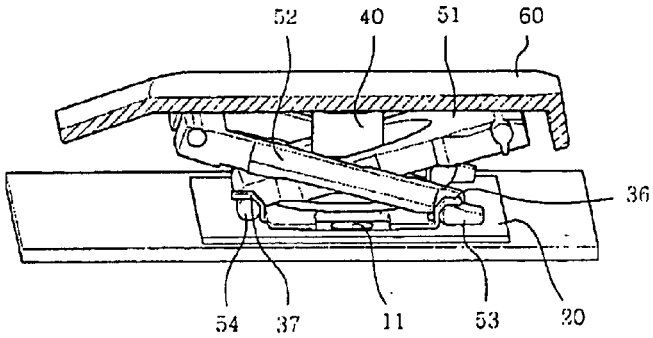
FIG. 4 is a partially-broken away perspective view of the key switch device according to the present invention.

FIG. 3 is an exploded perspective view illustrating one key switch device according to the present invention. FIG. 4 is a partially-broken away perspective view of the key switch device according to the present invention. As shown in FIGS. 3 and 4, the key switch device includes a linkage 50 arranged beneath the key top. The linkage 50 has an X-shaped link structure including a pair of link members mutually movable in a scissors fashion. The mounting member 30 of the key switch device is arranged beneath the linkage 50 so as to support the link members such that they are mutually movable in a scissors fashion.

An elastic switch 40 is arranged inside the linkage 50 and mounting member 30.

The elastic switch 40 is provided at its inner surface with a downward protrusion 41 so that it performs a switching operation in accordance with vertical movement of the key top 60.

The elastic switch 40 is made of a rubber material so that it upwardly urges the key top 60 against a downward force applied to the key top 60 by its resilience.

The membrane 20, which is a flexible printed circuit board, is arranged beneath the mounting member 30. Beneath the membrane 20, the support plate 10 is arranged to support the membrane 20.

The key top 60 is provided with recesses (not shown) for receiving upper support protrusions 55 and 56 formed at respective upper ends of the link members included in the linkage 50. As the support protrusions 55 and 56 are received in the recesses, the linkage 50 is coupled to the key top 60.

In the embodiment illustrated in FIG. 3, the linkage 50 includes an inner link member 51, and an outer link member 52 having a U-shaped structure. The inner and outer link members 51 and 52 are arranged such that the inner link member 51 is positioned inside the outer link member 52, while being hingably coupled to each other at central portions thereof. Accordingly, the inner and outer link members 51 and 52 are coupled to each other so that they are mutually movable in a scissors fashion. In accordance with such movements, the inner and outer link members 51 and 52 function as guide members for moving the key top 60 in a vertical direction.

The inner link member 51 is provided at opposite sides of lower and upper ends thereof with support protrusions 54 and 56, respectively, whereas the outer link member 52 is provided at lower and upper ends thereof with support protrusions 53 and 55, respectively.

The support protrusions 56 provided at the upper end of the inner link member 51 have a vertically elongated structure. These support protrusions 56 are received in and engaged with vertical grooves 61 (FIG. 6) formed at the key top 60, respectively. The support protrusions 54 provided at the lower end of the inner link member 51 are selectively engagable with inner support pieces 37 formed at the mounting member 30, while being laterally movable, respectively.

The support protrusions 55 provided at the upper end of the outer link member 52 are received in and engaged with horizontal grooves formed at the key top 60, whereas, the support protrusions 53 provided at the lower end of the outer link member 52 are engaged with outer support pieces 36 formed at the mounting member 30.

Thus, the inner and outer support pieces 37 and 36 of the mounting member 30 perform a function of holding the lower support protrusions 54 and 53 of the inner and outer link members 51 and 52.

The inner link member 51 is also provided with a guide opening 57 having an inner diameter larger than the outer diameter of the elastic switch 40. When the inner link member 51 coupled to the outer link member 52 inside the outer link member 52 performs a hinged movement, the guide opening 57 can receive the elastic switch 40, thereby preventing the hinged movement of the inner link member 51 from interference by the elastic switch 40.

The support protrusions 53 provided at the lower end of the outer link member 52 have a laterally elongated structure having a horizontal surface adapted to come into contact with the support plate 10. When the outer link member 52 moves upwardly to rise, the horizontal surfaces of the support protrusions 53 come into contact with the support plate 10, thereby stopping the upward movement of the outer link member 52.

The support protrusions 54 provided at the lower end of the inner link member 51 has a cylindrical structure. When the inner and outer link members 51 and 52 mutually move in a scissors fashion, the support protrusions 54 of the inner link member 51 move laterally, thereby causing the key top 60 to move vertically.

The inner link member 51 is formed at its lower surface with an arc-shaped support groove 51*a* (FIG. 8) adapted to come into contact with one lateral end of the mounting member 30, thereby supporting the inner link member 51 in a vertical direction.

Meanwhile, the elastic switch 40 has a hollow truncated conical structure while having an annular flange with an enlarged diameter at its lower end.

The elastic switch 40 is made of a rubber material. As described above, the elastic switch 40 is provided with the downward protrusion 41 at its inner surface. When the key top 60 is depressed, the elastic switch 40 is depressed, thereby causing its downward protrusion 41 to come into contact with the associated contact 4. Thus, the depression of the key top 60 is detected.

Thus, the elastic switch 40 cooperates with a circuit including the contact 4 to perform an input signal switching function.

Typically, the elastic switch 40 can be inexpensively fabricated when it has a structure separate from the membrane 20 to be arranged therebeneath. In this case, however, it is difficult to align the downward protrusion 41 of the elastic switch 40 with the contact unless the elastic switch 40 is fixed to the membrane 20, because the downward protrusion 41 moves to come into contact with the membrane 20. As a result, the input from the key switch device may not be reliably transmitted to the circuit.

In order to prevent such a problem, the elastic switch may be fabricated in such a manner that it is integral with the membrane. However, this method is expensive. Accordingly, the mounting member may be provided with a flange formed around at its central opening to fix the elastic switch thereto. In this case, although the elastic switch is fabricated, separately from the membrane, it is possible to provide an appropriate holding means for holding the elastic switch in position.

Since the elastic switch is typically made of a flexible material such as resin, it is possible to easily insert the elastic switch into the central opening of the mounting member even when the flange adapted to fix the elastic switch is formed around the central opening of the mounting member.

Figure 5A:
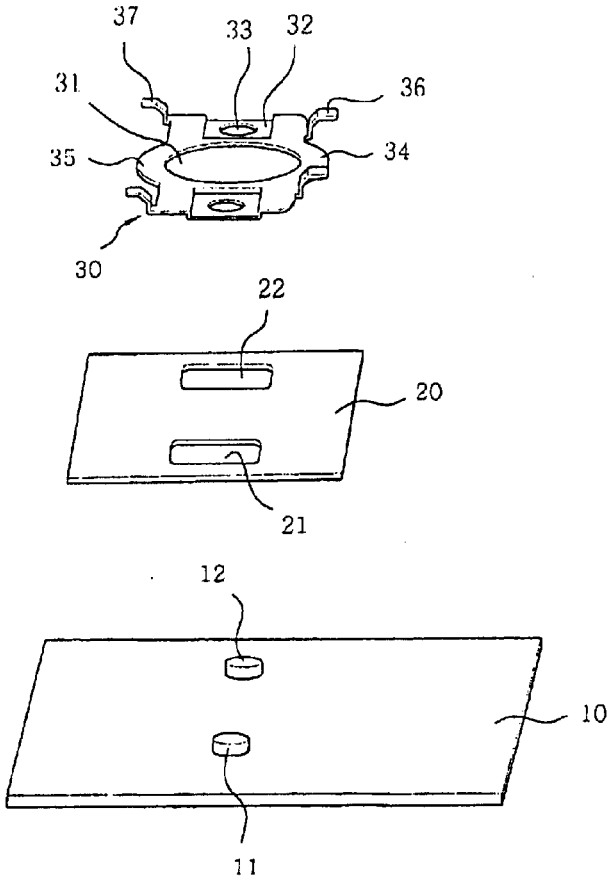
FIGS. 5*a* to 5*c* are perspective views respectively illustrating sequential processing steps of a process for coupling a mounting member according to the present invention.

Meanwhile, the mounting member 30 is fabricated by machining a thin sheet. As shown in FIG. 5*a*, the mounting member 30 has an annular frame including a pair of arc-shaped and substantially flat frame portions 34 and 35. The mounting member 30 also has a pair of extensions at opposite sides of the flame portions 34 and 35, respectively.

The mounting member 30 is also provided at opposite sides of front and rear ends thereof with inner support pieces 37 adapted to be engagable with the support protrusions 54 provided at the lower end of the inner link member 51, and outer support pieces 36 adapted to be engagable with the support protrusions 53 provided at the lower end of the outer link member 52, respectively.

The inner support pieces 37 extend from the front end of the mounting member 30 at regions where the arc-shaped frame 35 is connected with the extensions of the mounting member 30, respectively. On the other hand, the outer support pieces 36 extend from the rear end of the mounting member 30 at regions where the arc-shaped frame 34 is connected with the extensions of the mounting member 30, respectively.

Each inner support piece 37 has a 180°-rotated L-shaped flange structure extending upwardly from the region where the arc-shaped frame 35 is connected with an associated one of the extensions, and then being forwardly bent. The inner support pieces 37 can receive the lower support protrusions 54 of the inner link member 51 while allowing rotation of the lower support protrusions 54 therein, respectively.

Each outer support piece 36 has a 90°-rotated L-shaped flange structure extending upwardly from the region where the arc-shaped frame 34 is connected with an associated one of the extensions, and then being rearwardly bent. The outer support pieces 36 can receive the lower support protrusions 53 of the outer link member 52 while allowing rotation of the lower support protrusions 53 therein, respectively.

Respective extensions of the mounting member 30 are formed with fitting holes 33 in which cocking members 11 and 12 are to be fitted. A recess 32 is formed around each fitting hole 33 so that the coupling between the membrane 20 and the support plate 10 can be easily carried out.

The mounting member 30 is also centrally provided with a circular opening 31 where the elastic switch 40 is to be arranged. The opening 31 has an inner diameter equal to or slightly larger than the outer diameter of the elastic switch 40 at the lower end of the elastic switch 40.

The mounting member 30 is fabricated by machining a sheet made of iron or an alloy thereof. Preferably, the mounting member 30 is made of a material having a high strength, such as stainless steel.

In accordance with the present invention, the support plate 10 is arranged beneath the key top 60 while having a structure not including holes, as compared to conventional cases. In conventional cases, such a support plate is cut to form mounting pieces, so that holes are formed through the support plate. In accordance with the present invention, however, cocking members 11 and 12 are provided at desired positions on the support plate 10.

The membrane 20 arranged on the support plate 10 is provided with slots 21 and 22 at regions around the cocking members 11 and 12, so as to allow the cocking members 11 and 12 to be upwardly exposed through the slots 21 and 22.

The process for manufacturing key switch devices each having the above described structure according to the present invention will now be described.

First, a first sheet having a small thickness is prepared for each key switch device. The first sheet is made of a material having a sufficient strength, such as stainless steel. The first sheet is machined using a machining device such as a die press, thereby fabricating the mounting member 30 for each key switch device.

In order to fabricate the support plate 10, a second sheet is prepared. The second sheet has a thickness larger than that of the first sheet while being made of a material having a sufficient strength, such as iron or stainless steel. The prepared second sheet is cut to have a desired shape conforming to the shape of a keyboard to which the support plate 10 is applied.

Desired numbers of cocking members 11 and 12 required for the key switching devices to be equipped in the keyboard are mounted to the cut second sheet. Thus, the fabrication of the support plate 10 is completed.

Thereafter, preparation of the membrane 20 printed with a flexible switching circuit required in the keyboard is carried out. Slots 21 and 22 corresponding in number to the cocking members 11 and 12 are then perforated through the membrane 20 at positions corresponding to respective cocking members 11 and 12.

The slots 21 and 22 have a size equal to or slightly larger than that of the cocking members 11 and 12.

Figure 5B:
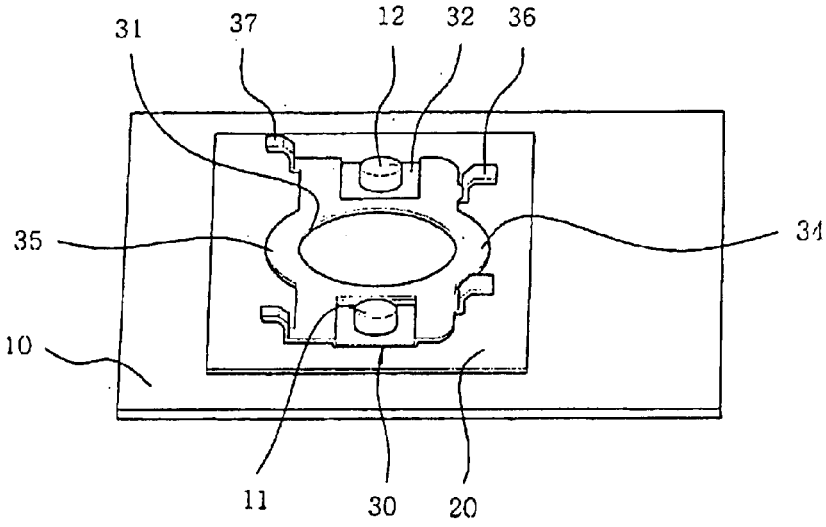

Subsequently, the membrane 20 is attached to the upper surface of the support plate 10, as shown in FIG. 5*a*. The mounting member 30 is then laid on the membrane 20. At this time, the cocking members 11 and 12 of the support plate 10 associated with the key switch device to be completed are fitted in the fitting holes 33 of the mounting member 30 such that they are upwardly protruded through the fitting holes 33, respectively (FIG. 5*b*).

Figure 5C:
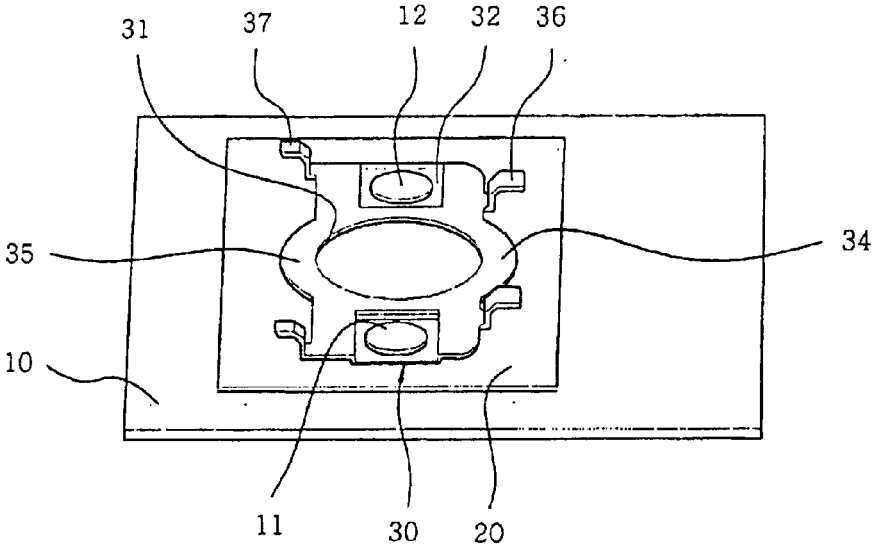

Thereafter, downward pressure is applied to the upper ends of the protruded cocking members 11 and 12, so that the protruded portions of the cocking members 11 and 12 to be downwardly pressed while being radially enlarged, thereby fixing the mounting member 30 to the support plate 10 (FIG. 5*c*).

The elastic switch 40 is then arranged within the central opening 31 of the mounting member 30 coupled to the support plate 10.

Subsequently, the lower support protrusions 53 and 54 of the inner and outer link members 51 and 52 are engaged with the mounting pieces 36 and 37 of the mounting member 30, respectively. Under this condition, the key top 60 is coupled to the inner and outer link members 51 and 52.

Thus, the manufacture of the key switch device according to the present invention is completed.

Now, the function and effect of the key switch device manufactured as above will be described.

Figure 6:
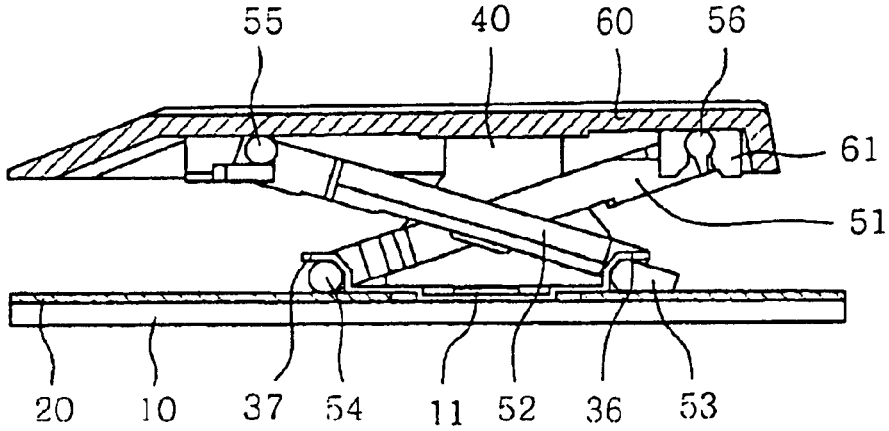
FIG. 6 is a partially-broken away side view of the key switch device according to the present invention, illustrating the condition in which the key switch device is in a standby state.

FIG. 6 is a partially-broken away side view of the key switch device according to the present invention, illustrating the condition in which the key switch device is in a standby state.

Figure 7:
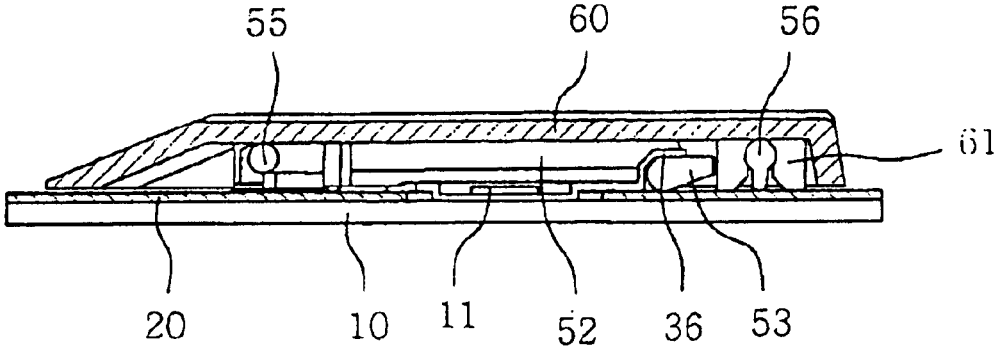
FIG. 7 is a partially-broken away side view of the key switch device according to the present invention, illustrating the condition in which the key switch device is in a key input state.

FIG. 7 is a partially-broken away side view of the key switch device according to the present invention, illustrating the condition in which the key switch device is in a key input state.

In the key switch device, the mounting member 30 is arranged beneath the key top 60 to support the link members 51 and 52, connected to each other in a crossing manner, such that they can perform a mutual hinged movement.

The elastic switch 40 is arranged inside the linkage 50 and mounting member 30 to upwardly support the key top 60.

The support protrusions 53 provided at the lower end of the outer link member 52 are engaged with respective outer support pieces 36 of the mounting member 30, whereas, the support protrusions 56 provided at the upper end of the inner link member 51 are received in and engaged with respective inner support pieces 37 of the mounting member 30. Also, the support protrusions 55 provided at the upper end of the outer link member 52 are received in respective horizontal grooves of the key top 60 such that they are horizontally movable.

In the standby state of the key switch device according to the present invention, the support protrusions 54 provided at the lower end of the inner link member 51 are engaged with respective inner support pieces 37 of the mounting member 30.

Since the support pieces 37 and 36 adapted to hold the lower support protrusions 53 and 54 of the linkage 50 are not formed at the support plate 10, but formed at the mounting member 30 separate from the support plate 10, in accordance with the present invention, there is no hole in the support plate 10. Accordingly, it is possible to waterproof the support plate 10 without using any waterproofing tape.

When the user depresses the key top 60 of the key switch device with his finger, thereby moving the key switch device from its standby state of FIG. 6 to its key input state of FIG. 7, each upper support protrusion 55 of the outer link member 52 is moved toward the inner end of the associated horizontal groove of the key top 60. At this time, the upper support protrusions 56 of the inner link member 51 are maintained in respective vertical grooves 61 of the key top 60.

As the inner and outer link members 51 and 52 are lowered in accordance with the depression of the key top 60, the support protrusions 54 provided at the lower end of the inner link member 51 are horizontally moved while being disengaged from respective support pieces 37 of the mounting member 30. At this time, the support protrusions 53 provided at the lower end of the outer link member 52 are slightly rotated in a counterclockwise direction in a state of being engaged with respective outer support pieces 36 of the mounting member 30, so that their horizontal surfaces are slightly spaced apart from the support plate 10, as shown in FIG. 7.

As the inner and outer link members 51 and 52 are lowered, the elastic switch 40 arranged inside the linkage 50 is downwardly pressed, thereby causing its downward protrusion 41 to depress the contact of the membrane 20. Thus, the key input from the key switch device is transmitted to a controller such as a central processing unit (CPU) (not shown).

When the user releases his finger from the key top 60, the elastic switch 40 returns to its original state by virtue of its elasticity. As a result, the inner and outer link members 51 and 52 rise, so that the entire portion of the key switch device returns to the state of FIG. 6.

As described above, each support protrusion 53 provided at the lower end of the outer link member 52 has a structure including a horizontal surface adapted to come into contact with the support plate 10. When the linkage 50 rises in accordance with the upward movement of the key top 60 carried out by virtue of the elasticity of the elastic switch 40, the horizontal surface of each support protrusion 53 comes into contact with the support plate 10 to serve as a stopper for stopping the upward movement of the key top 60 at a desired level.

Since the support protrusions 53 provided at the lower end of the outer link member 52 in the key switch device of the present invention comes into contact with the support plate 10, it is possible to prevent an excessive upward movement of the linkage 50. Thus, it is possible to horizontally maintain the key top 60 at a constant level.

Figure 8:
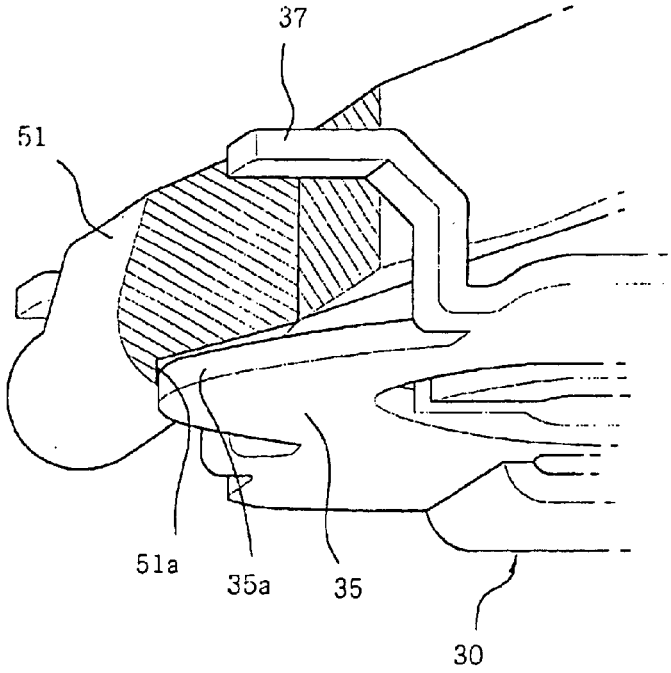
FIG. 8 is a perspective bottom view illustrating vertical support structures of a mounting member and an inner link member according to the present invention.
Figure 9:
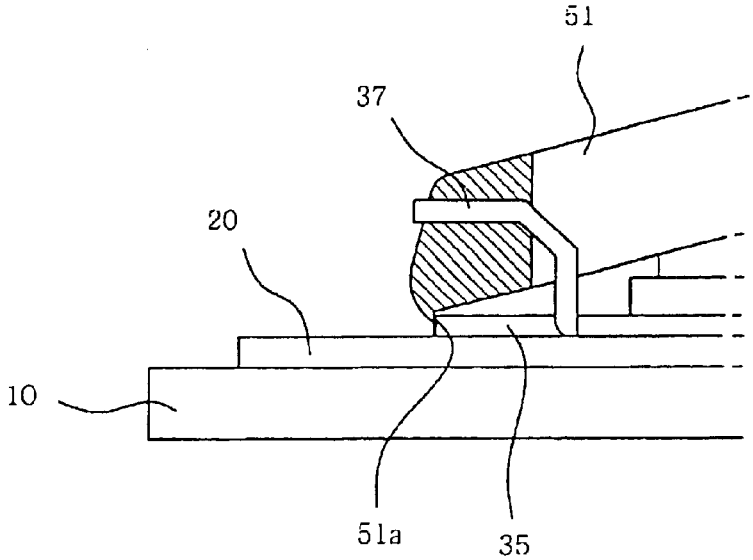
FIG. 9 is a front view illustrating the vertical support structures of the mounting member and inner link member according to the present invention.

FIG. 8 is a perspective bottom view illustrating the vertical support structures of the mounting member and inner link member according to the present invention. FIG. 9 is a front view illustrating the vertical support structures of the mounting member and inner link member according to the present invention. As described above, the inner link member 51 is provided at its lower surface with the arc-shaped support groove 51*a* adapted to come into contact with one lateral end of the mounting member 30. When the linkage 50 rises in accordance with the upward movement of the key top 60, the support groove 51*a* of the inner link member 51 comes into contact with the frame portion 35 of the mounting member 30, thereby vertically supporting the inner link member 51.

That is, the support groove 51*a* formed at the lower surface of the inner link member 51 is in contact with a vertical surface 35*a* of the frame portion 35 at a large area, thereby preventing a further upward movement of the linkage 50.

Since the surface area of the stoppers for stopping the upward movement of the linkage 50 in the key switch device of the present invention is wide, as compared to conventional devices, as apparent from the above description, it is possible to provide a stable use state of the key switch device.

As described above, the key switch device of the present invention is applicable to the keyboard of a portable electronic appliance such as a notebook computer. In addition to the keyboard, such a portable electronic appliance may include a liquid crystal display (LCD), a CPU, a memory adapted to store various programs, a main board mounted with diverse constitutive elements adapted to perform operations associated with the programs, and a power supply.

The portable electronic appliance receives a signal inputted in accordance with an operation of the key switch device, and displays the signal on the LCD, while executing a desired program under the control of the CPU. The keyboard employing key switch devices having a configuration according to the present invention is waterproofed without using a separate waterproofing structure. Also, there is no problem of tilting of key tops in this keyboard. Thus, a stable key use state is provided, so that the quality of the keyboard is improved.

As apparent from the above description, in accordance with the key switch device of the present invention, the mounting member adapted to mount the inner and outer link members is configured, separately from the support plate. Accordingly, it is possible to simplify the structure of the support plate. As the mounting member is fabricated, separately from the support plate, it is unnecessary to use an accuracy machining process for the fabrication of the support plate, as compared to conventional cases. Accordingly, it is possible to easily fabricate the support plate. In addition, there is a reduction in cost because even when the mounting member is broken, it is unnecessary to replace the support plate with a new one.

Also, the mounting member can be made of a rigid material such as stainless steel. Accordingly, it is possible to increase the durability of the mounting member. The support plate can also be made of a rigid and inexpensive material other than aluminum used in conventional cases. Accordingly, it is possible to increase the durability of the support plate while reducing the manufacturing cost of the support plate.

In accordance with the present invention, the mounting member is mounted to the support plate by use of cocking members. Since no hole is formed at the support plate in this case, it is possible to waterproof the support plate without using any waterproofing tape, and thus, to reduce the assembly elements and processes while achieving an improvement in the workability of the assembly process.

The construction of a jig to be used for the formation of the cocking members at the support plate is simple, as compared to conventional cases. Accordingly, it is possible to reduce the manufacturing cost of the support plate while achieving an increase in productivity.

The support protrusions provided at the linkage to stop an excessive upward movement of the linkage serve as horizontal stoppers while vertically supporting the linkage in cooperation with the arc-shaped frame portion of the mounting plate. Since the surface area of the stoppers is wide, it is possible to provide a stable use state of the key switch device. Also, the support protrusions serve to horizontally maintain the key top at a constant level.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A key switch device comprising:

inner and outer link members connected to each other in a crossing manner to mutually move in a scissors fashion, each of the inner and outer link members having support protrusions respectively provided in pairs at lower and upper ends thereof;

a key top provided with receiving portions adapted to receive the support protrusions provided at respective upper ends of the inner and outer link members;

an elastic switch provided at an inner surface thereof with a downward protrusion adapted to perform a switching operation in accordance with a vertical movement of the key top;

a support plate arranged beneath the key top, and provided with cocking members at predetermined positions, respectively;

a membrane arranged on the support plate, and printed with a circuit having a contact, with which the downward protrusion of the elastic switch comes into contact, and a switch pattern, the membrane having slots for allowing the cocking members to be upwardly protruded therethrough; and a mounting member arranged on the membrane, the mounting member having support pieces adapted to be engaged with respective support protrusions provided at the lower ends of the inner and outer link members, a central opening adapted to receive the elastic switch, and fitting holes adapted to allow the cocking members to be fitted therein.

2. The key switch device according to claim 1, wherein at least one of the support protrusion pairs provided at respective lower ends of the inner and outer link members has horizontal surfaces provided at respective support protrusions of the at least one support protrusion pairs, and adapted to come into contact with the support plate when the key top moves upwardly to a predetermined level, thereby stopping the upward movement of the key top.

3. The key switch device according to claim 2, wherein the support protrusions provided with the horizontal surfaces are provided at the lower end of the outer link member.

4. The key switch device according to claim 3, wherein the support protrusions provided at the lower end of the inner link member have a cylindrical structure while being laterally movable during the scissors movements of the inner and outer link members.

5. The key switch device according to claim 4, wherein the inner link member is provided at a lower surface thereof with a support groove adapted to come into contact with one lateral end of the mounting member when the key top moves upwardly to the predetermined level, thereby vertically supporting the inner link member.

6. The key switch device according to claim 5, wherein the support groove has an arc shape.

7. The key switch device according to claim 1, wherein the opening of the mounting member has a circular shape, and the mounting member has an annular frame formed around the circular opening while having a predetermined thickness.

8. The key switch device according to claim 1, wherein the support pieces of the mounting member are provided in pairs at front and rear ends of the mounting member, respectively, such that the support pieces included in the support piece pair provided at the front end of the mounting member are engaged with respective support protrusions provided at the lower end of the inner link member, whereas the support pieces included in the support piece pair provided at the rear end of the mounting member are engaged with respective support protrusions provided at the lower end of the outer link member.

9. The key switch device according to claim 1 or 8, wherein each of the support pieces has a 180°-rotated L shape.

10. The key switch device according to claim 1, wherein the mounting member is made of stainless steel.

11. The key switch device according to claim 1, wherein the fitting holes are arranged at opposite sides of the opening, respectively, such that they are symmetrical with respect to a center line of the opening.

12. The key switch device according to claim 11, wherein the mounting member has recesses respectively formed around the fitting holes.

13. A method for manufacturing a key switch device, comprising the steps of:

(A) cutting a plurality of first sheets respectively corresponding to the key switch devices to be manufactured, while having a predetermined strength, and forming support pieces, an opening, and fitting holes at each of the cut first sheets, thereby forming a plurality of mounting members respectively corresponding to the key switch devices;

(B) cutting a second sheet to have a structure conforming to a shape required in a keyboard, and forming a plurality of cocking members at the cut second sheet, thereby forming a support plate;

(C) preparing a membrane printed with a flexible switching circuit, and forming a plurality of slots, corresponding in number to the cocking members, at positions corresponding to those of the cocking members, respectively;

(D) attaching the membrane to an upper surface of the support plate, positioning the mounting members on the membrane such that the cocking members are fitted in the coupling holes of the mounting members through the slots of the membrane, and protruded from the coupling holes at upper ends thereof, respectively, and applying a downward pressure to the protruded upper ends of the cocking members, thereby fixing the mounting members to the support plate;

(E) arranging elastic switches in respective central openings of the mounting members fixed to the support plate;

(F) preparing a plurality of linkages each including inner and outer link members connected to each other in a crossing manner to mutually move in a scissors fashion, each of the inner and outer link members having support protrusions provided at lower and upper ends thereof, and engaging the support protrusions provided at respective lower ends of the inner and outer link members included in each of the linkages with the support pieces provided at an associated one of the mounting members, respectively; and (G) preparing a plurality of key tops each having receiving portions, and assembling the key tops to the linkages such that the support protrusions provided at respective upper ends of the inner and outer link members included in each of the linkages are received in and engaged with the receiving portions of an associated one of the key tops, respectively.

14. The method according to claim 13, wherein the slots are formed, at the step (C), to have a size equal to or slightly larger than that of the cocking members.

* * * * *